US008177318B2

(12) United States Patent
Govyadinov et al.

(10) Patent No.: US 8,177,318 B2
(45) Date of Patent: May 15, 2012

(54) ORIFICE HEALTH DETECTION DEVICE

(75) Inventors: Alexander Govyadinov, Corvaltis, OR (US); Vanessa Verzwyvelt, Vancouver, WA (US); Prodpran Suetrong, Bangkok (TH); Jeffrey T. Hendricks, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 194 days.

(21) Appl. No.: 12/381,873

(22) Filed: Mar. 17, 2009

(65) Prior Publication Data

US 2009/0244141 A1 Oct. 1, 2009

Related U.S. Application Data

(63) Continuation-in-part of application No. 12/079,338, filed on Mar. 25, 2008.

(51) Int. Cl.
*B41J 29/393* (2006.01)

(52) U.S. Cl. ..... 347/19; 347/52; 347/81

(58) Field of Classification Search ..... 347/19, 347/81, 14, 37, 40, 44, 51, 52
See application file for complete search history.

(56) References Cited

U.S. PATENT DOCUMENTS 4,422,719 A * 12/1983 Orcutt ..... 385/123
5,304,814 A 4/1994 Markham
5,428,218 A 6/1995 Toughlian et al.
5,589,858 A 12/1996 Kadowaki et al.
5,621,524 A * 4/1997 Mitani ..... 356/338
5,742,303 A 4/1998 Taylor et al.
5,774,141 A 6/1998 Cooper et al.
5,856,833 A 1/1999 Elgee et al.
5,896,145 A 4/1999 Osborne et al.
6,088,134 A 7/2000 Schmidt
6,168,258 B1 1/2001 Lou et al.
6,299,275 B1 10/2001 Elgee
6,513,900 B2 2/2003 Endo et al.
6,517,184 B1 2/2003 Bruch
6,525,863 B1 2/2003 Riza
6,565,179 B1 5/2003 Bruch
6,585,349 B1 7/2003 Lou et al.
6,648,444 B2 11/2003 Valero
6,747,684 B2 6/2004 Ornellas et al.
6,767,122 B2 7/2004 Honguh et al.
6,769,756 B2 8/2004 Su
6,786,626 B2 9/2004 Wu et al.
6,802,580 B2 10/2004 Valero
6,814,422 B2 11/2004 Bruch (Continued)

FOREIGN PATENT DOCUMENTS

JP 2001113725 4/2001

(Continued)

OTHER PUBLICATIONS

The Restriction Requirement for U.S. Appl. No. 12/079,338 mailed on Mar. 17, 2011 (7 pages).

(Continued)

*Primary Examiner* — Thinh Nguyen

(57) ABSTRACT

An orifice health detection device includes a fixed array of ink ejecting orifices, the ink ejecting orifices configured to eject at least one ink drop, a light source that produces a light beam configured to scatter light from the at least one ejected ink drop, and a light detector configured to detect light scattered from the at least one ejected ink drop.

18 Claims, 4 Drawing Sheets

U.S. PATENT DOCUMENTS

| | | | | |
|---|---|---|---|---|
| 6,851,816 | B2 | 2/2005 | Wu et al. | |
| 6,877,838 | B2 | 4/2005 | Elgee | |
| 6,935,717 | B2 | 8/2005 | Su | |
| 6,966,664 | B2 | 11/2005 | Wu | |
| 6,969,159 | B2 | 11/2005 | Su | |
| 6,984,013 | B2 | 1/2006 | Arqullevich et al. | |
| 7,055,925 | B2 | 6/2006 | Subirada et al. | |
| 7,125,151 | B2 | 10/2006 | Uemura et al. | |
| 7,140,762 | B2 | 11/2006 | Wu et al. | |
| 7,249,830 | B2 | 7/2007 | Hawkins et al. | |
| 7,267,467 | B2 | 9/2007 | Wu et al. | |
| 7,287,824 | B2 | 10/2007 | Subirada | |
| 7,287,833 | B2 | 10/2007 | Howard | |
| 7,364,276 | B2 | 4/2008 | Piatt et al. | |
| 7,434,919 | B2 | 10/2008 | Hawkins | |
| 7,442,180 | B2 | 10/2008 | Vitello | |
| 7,452,053 | B2 | 11/2008 | Valles et al. | |
| 7,490,918 | B2 | 2/2009 | Nagashima | |
| 7,513,616 | B2 | 4/2009 | Lin | |
| 7,832,822 | B2 * | 11/2010 | Kiyama et al. | 347/14 |
| 2001/0019480 | A1 | 9/2001 | Fujino et al. | |
| 2003/0193608 | A1 * | 10/2003 | Yen | 348/340 |
| 2005/0024410 | A1 | 2/2005 | Subirada et al. | |
| 2005/0253890 | A1 * | 11/2005 | Nagashima | 347/19 |
| 2006/0103691 | A1 * | 5/2006 | Dietl et al. | 347/40 |
| 2006/0120098 | A1 | 6/2006 | Ikeda et al. | |
| 2006/0139392 | A1 | 6/2006 | Fernandez et al. | |
| 2006/0187651 | A1 | 8/2006 | Kim et al. | |
| 2006/0279601 | A1 | 12/2006 | Unosawa et al. | |
| 2007/0024658 | A1 | 2/2007 | Diol et al. | |
| 2007/0030300 | A1 * | 2/2007 | Jeong | 347/19 |
| 2007/0064068 | A1 | 3/2007 | Piatt et al. | |
| 2008/0180471 | A1 | 7/2008 | Han | |
| 2008/0246803 | A1 | 10/2008 | Barger et al. | |
| 2009/0091595 | A1 | 4/2009 | Hayashi et al. | |
| 2009/0141057 | A1 | 6/2009 | Hayashi et al. | |
| 2009/0179934 | A1 | 7/2009 | Takagi et al. | |
| 2009/0244163 | A1 | 10/2009 | Govyadinov | |
| 2009/0273620 | A1 | 11/2009 | Govyadinov et al. | |
| 2009/0310206 | A1 | 12/2009 | Gluckstad | |
| 2010/0207989 | A1 | 8/2010 | Govyadinov | |
| 2011/0090275 | A1 | 4/2011 | Govyadinov et al. | |

FOREIGN PATENT DOCUMENTS

| | | |
|---|---|---|
| JP | 2005083769 | 3/2005 |
| JP | 2006047235 | 2/2006 |
| JP | 2006346906 | 12/2006 |
| JP | 2007119971 | 5/2007 |
| WO | 2007015808 | 2/2007 |
| WO | 2009120436 | 10/2009 |

OTHER PUBLICATIONS

The Restriction Requirement for U.S. Appl. No. 12/388,805 mailed on Jul. 14, 2011 (6 pages).

The Office Action for U.S. Appl. No. 12/254,864 mailed on Jun. 11, 2010 (23 pages).

The Office Action for U.S. Appl. No. 12/079,338 mailed on Jul. 25, 2011 (15 pages).

The Office Action for U.S. Appl. No. 12/388,805 mailed on Aug. 25, 2011 (19 pages).

The Notice of Allowance for U.S. Appl. No. 12/254,864 mailed on Dec. 1, 2010 (12 pages).

The International Search Report for International Application No. PCT/US2009/034892 mailed on Jul. 28, 2009 (7 pages).

The Written Opinion for International Application No. PCT/US2009/034892 mailed on Jul. 28, 2009 (5 pages).

McLeod, Euan et al., "Complex Beam Sculpting with Tunable Acoustic Gradient Index Lenses," SPIE, Complex Light and Optical Forces, vol. 6483, pp. 1-9, (2007).

Svanholm, Erik, "Printability and Ink-Coating Interactions in Inkjet Printing," Dissertation, Karlstad University Studies 2007:2, pp. 58 (Feb. 2007).

* cited by examiner

ORIFICE HEALTH DETECTION DEVICE

This application is a continuation in part of U.S. patent application Ser. No. 12/079,338, filed on Mar. 25, 2008, entitled A DROP DETECTION MECHANISM AND METHOD OF USE THEREOF, and hereby incorporated by reference herein.

BACKGROUND

Printing devices, such as thermal ink jet printers, may include orifice plates including multiple orifices therein. A determination of orifice health, i.e., if an individual orifice is occluded, and if so, to what extent, and whether or not the ejection device of the individual orifice is functioning, may be periodically determined so as to schedule orifice plate maintenance and/or to compensate for the occluded orifice by use of another orifice during printing. Testing individual ones of the multiple orifices sequentially may be time consuming and may utilize expensive equipment.

DETAILED DESCRIPTION OF THE DRAWINGS

FIGS. 1-8 are schematic bottom views of example embodiments of a printing device 10 including example embodiments of a printing orifice health detection device 12.

Figure 1:
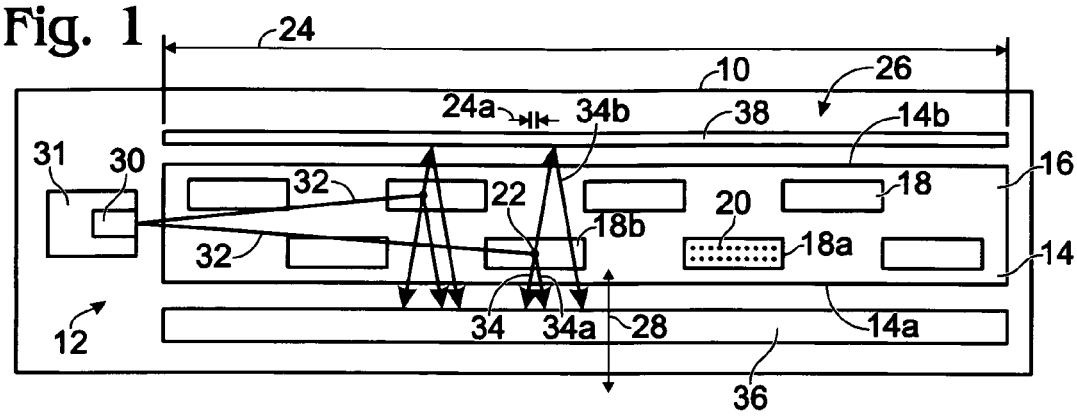
FIGS. 1-8 are schematic bottom views of example embodiments of a printing device including example embodiments of components of a printing orifice health detection device.

FIG. 1 is a schematic bottom view of one example embodiment of a printing device 10 including one example embodiment of a printing orifice health detection device 12. Printing device 10 may be a printer, such as a thermal or a piezoelectric ink jet printer, for example.

Printing device 10 may include an ink ejection array 14, such as an orifice plate 16. In the embodiment shown, orifice plate 16 includes multiple die 18, wherein each of die 18 includes multiple individual orifices 20 (several example orifices are shown on example die 18*a*), wherein the individual orifices 20 are each configured to sequentially eject a fluid droplet, such as an ink droplet 22, therefrom (one example ink droplet 22 is shown as ejected from an orifice 20 on a die 18*b*).

The group of individual die 18 of array 14 may collectively define set of orifices 20 that may extend completely across a width 24 of a printzone 26. A sheet of print media (not shown in this figure) may move past array 14 along an axis 28 that is perpendicular to width 24, such that array 14 may be referred to as a page wide printing array. In other words, die 18 of the embodiment shown, including orifices 20, are not moved along a direction parallel to width 24 as which may be the case in a printer including a movable carriage mounted printhead. Accordingly, in the embodiment shown, array 14 may also be referred to as a fixed or a stationary printing array 14 because die 18 remain stationary in their position with respect to axis 28 and along width 24. (In another embodiment shown in FIG. 8 array 14 may be indexed in a direction of axis 28 but such an embodiment is also referred to as a fixed array because the array 14 does not move side-to-side in the direction of width 24).

Page wide arrays differ from traditional movable print carriage printing systems. In particular, page wide arrays may not provide for manifold nozzle redundancy of scanning printing head engines, i.e., each nozzle of a page wide array may be the sole ink printing orifice for a particular region of a page and, therefore, print quality may be degraded by occlusion of a single orifice. Print quality may be enhanced by a precise knowledge of the health of each nozzle before starting printing of an image. Knowledge of an occluded or otherwise unhealthy print nozzle orifice in a page wide array may enable the writing system of the printer to apply a limited nozzle substitution so as to provide a high quality printed image.

Page wide array products are not available in consumer and commercial printing markets because of the high complexity and stringent requirements of the writing system to support a high quality, ink printing page wide array that includes a nozzle health drop detector. However, because of the potential high productivity of such page wide arrays, the low noise generated by such page wide arrays, and the small form factors of page wide arrays, it may be desirable to provide a low cost page wide array printer for all printing market segments from consumer/office printers to digital presses. Providing a low cost page wide array printer may be feasible if a low cost drop detection device can be formulated for use in a page wide array printer.

Use of drop detectors has not heretofore been utilized in page wide printing arrays because of lack of experience, high complexity, high cost, and difficulties of scalability, i.e., providing a drop detector for the entire page wide array. Typically, drop detectors developed for traditional small and scanning printers are not scalable to page wide arrays because traditional drop detectors do not have a wide angle field of view. In particular, if the detector utilized is an electrostatic detector, such a page wide electrostatic detector would have a prohibitively large cost because of the noble metal coatings used on the detector. Moreover, if an electrostatic detector is utilized in a page wide array, such a detector would have an increased electrode area and would correspondingly increase the noise floor detection system utilized. Moreover, such large electrostatic detectors would not function reliably and therefore would be useless for page wide array applications. Accordingly, classical scanning drop detectors used in upscaled products are not reliable, are very slow, and do not meet the expectations of cost and performance. In other words, a page wide array electrostatic drop detector would have a huge footprint, which is a challenge for traditionally functioning electrostatic drop detectors.

In contrast, the light scattering optical system of the present invention is very scalable, has no moving parts for the optical detector which renders the detector more reliable, which is important for large page wide array printers. Additionally, light pipes utilized in the light scattering optical system of the present invention are scalable for page wide arrays with little cost increase. Accordingly, the light scattering optical system of the present invention will be hereinafter described in more detail.

In printers including page wide arrays 14, each of the individual orifices 20 may be solely responsible for printing ink within its own individual region within width 24 of printzone 26, such as a region 24*a* (shown large for ease of illustration) in which ink droplet 22 is shown. Accordingly, if a particular orifice 20, also referred to as a nozzle, is fully or even partially occluded, the finished printed product may include an unprinted line extending along a length of the printed print media in a line parallel to axis 28 and across a width of the orifice region 24*a*, for example. Accordingly, determining the health of each of the individual orifices 20 of array 14, i.e., whether or not the individual orifice 20 is occluded and if so to what extent, and if the ink ejection mechanism of the individual orifice is functioning, in such page wide arrays 14 may allow corrective measures to be taken to reduce or eliminate unprinted regions in the finished printed product. For example, if a particular orifice 20 is found by the printing orifice health detection device 12 to be occluded or the ejection device for the particular orifice is not functioning, servicing of the array 14 may be conducted, or adjacent orifices may be activated to eject ink therefrom to compensate for the non-functioning orifice.

Health detection device 12 may include a light source 30, such as a collimated light source, and more particularly, a laser light source, that may produce a light beam 32 that is projected across orifice plate 16. Any shape of light beam 32 may be utilized. A rectangular cross sectional shape of light beam 32 is shown in the embodiments illustrated for ease of illustration. Light source 30 may be connected to a controller, such as a printed circuit board 31 on which the light source may be positioned. Light beam 32 may be projected such that ink droplets 22 that are ejected from array 14 will pass through light beam 32 enroute to a servicing station or a sheet of print media, for example (not shown in this figure). As the ink droplets 22 pass through light beam 32, light is scattered from ink droplets 22 to produce scattered light 34.

Scattered light 34 may be directed as scattered light 34*a* directly toward a light detection device 36, or as scattered light 34*b* toward a light guide device 38, which is then projected to light detection device 36 by light guide device 38. In this embodiment, light guide device 38 ay be a reflector, such as a mirror. Light detection device 36 may be a contact image sensor (CIS), which in one embodiment may be a complementary metal oxide semiconductor (CMOS) line array as shown in this figure, or may be a photo diode (shown in FIG. 2). A predetermined low threshold light intensity may indicate the presence of an ink drop 22 and a predetermined high threshold light intensity may indicate the absence of an ink drop 22. In the embodiment shown in FIG. 1, light detection device 36 is positioned parallel to and extending along one side 14*a* of array 14 and throughout width 24 of printzone 26, and light guide device 38 is positioned on an opposite side 14*b* of array 14.

Controller 31 may receive light scattering information detected by light detection device 36 and may utilize the light scattering information to determine a health of an orifice 20 that ejected a particular ejected ink drop 22 that corresponds to the light scattering information detected by light detection device 36.

Figure 2:
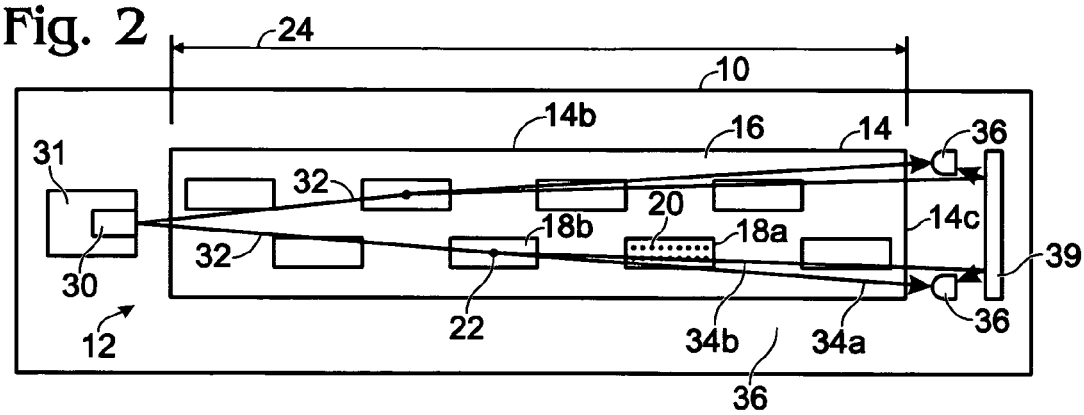

FIG. 2 is a schematic bottom view of one example embodiment of a printing device 10 including one example embodiment of a printing orifice health detection device 12. Device 10 may include an array 14 including multiple die 18, each die 18 including multiple orifices 20 therein. Device 12 may include a single light source 30, a light guide 39 that is positioned at an end 14*c* of array 14 and perpendicular to a width 24 of said page wide array 14, and a light detection device 36 including four light diodes each positioned at a corner of array 14. Light guide 39 may internally redirect scattered light 34*a* and/or 34*b*.

Figure 3:
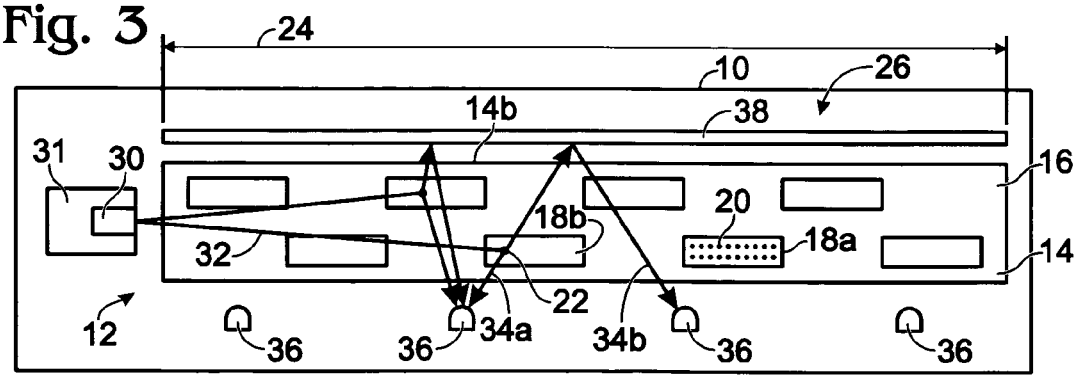

FIG. 3 is a schematic bottom view of one example embodiment of a printing device 10 including one example embodiment of a printing orifice health detection device 12. Device 10 may include an array 14 including multiple die 18, each die 18 including multiple orifices 20 therein. Device 12 may include a single light source 30, a light guide 38 that is positioned along the width 24 of printzone 26 adjacent to side 14*b* of array 14, and a light detection device 36 including four light diodes each positioned along an edge 14*a* of array 14.

Figure 4:
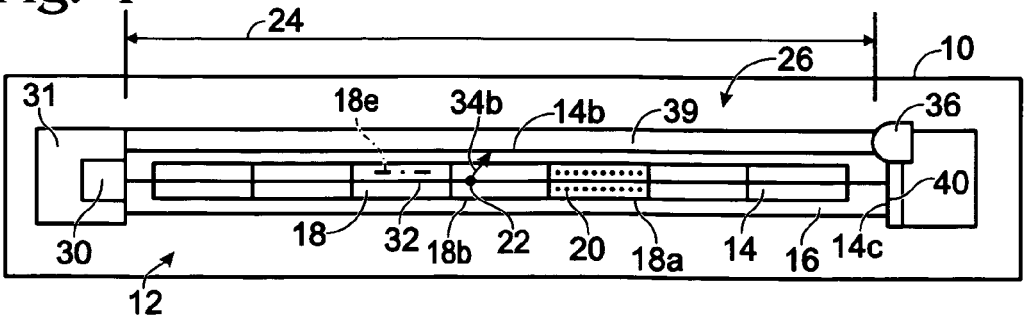

FIG. 4 is a schematic bottom view of one example embodiment of a printing device 10 including one example embodiment of a printing orifice health detection device 12. Device 10 may include an array 14 including multiple die 18, each die 18 including multiple orifices 20 therein. In this embodiment, each of individual die 18 are aligned with each other along a single axis 18*a* on array 14. Device 12 may include a single light source 30, a light guide 39 that is positioned along the width 24 of printzone 26 adjacent to side 14*b* of array 14, and a light detection device 36 including a single light diode positioned at an end 14*c* of array 14 and connected to light guide 38. In this embodiment, detection device 12 may further include a light stop 40 positioned at end 14*c* of array 14, wherein light stop 40 stops the further projection of projected light beam 32.

Figure 5:
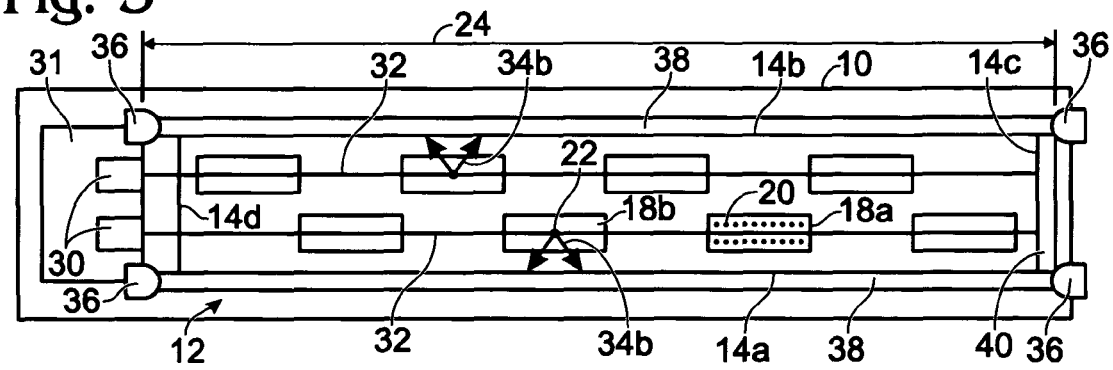

FIG. 5 is a schematic bottom view of one example embodiment of a printing device 10 including one example embodiment of a printing orifice health detection device 12. Device 10 may include an array 14 including multiple die 18, each die 18 including multiple orifices 20 therein. Device 12 may include two light sources 30, two light guides 38 that are each positioned along the width 24 of printzone 26 adjacent to sides 14*a* and 14*b* of array 14, respectively, and a detection device 36 including two or more light diodes, each one positioned at an end 14*d* of array 14 and each connected to a light guide 38. In this embodiment, detection device 12 may further include a light stop 40 positioned at end 14*c* of array 14, wherein light stop 40 stops the further projection of projected light beam 32. This embodiment may be more expensive to manufacture than an embodiment utilizing one light source, one light guide 38 and one light detector 36. However, this embodiment may be more reliable in use because mirrors (see FIG. 6) are not utilized to project light beam 32 along a long path, and motors are not utilized to index a position of array 14 (see FIG. 8). In this embodiment, detection devices 36 positioned at the right side of the figure may be the primary light detectors because these detectors may detect a stronger light signal than the detection devices 36 on the left side of the figure. Accordingly, in another embodiment, detection devices 36 on the left side of the figure may be optional and may not be utilized.

Figure 6:
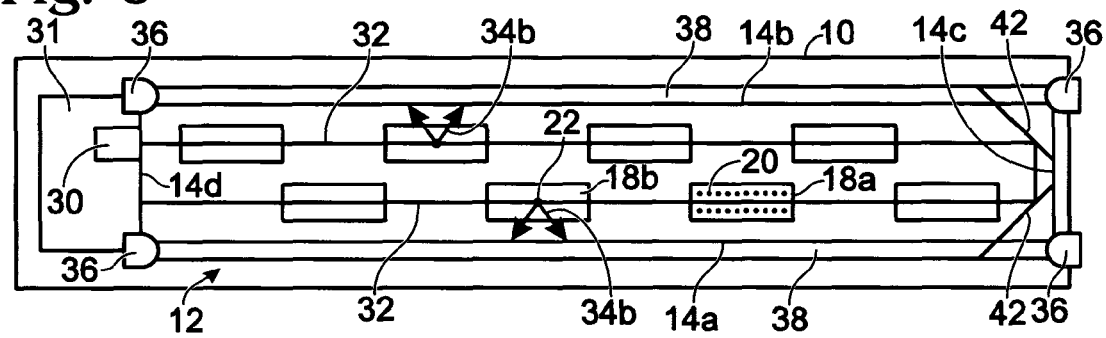

FIG. 6 is a schematic bottom view of one example embodiment of a printing device 10 including one example embodiment of a printing orifice health detection device 12. Device 10 may include an array 14 including multiple die 18, each die 18 including multiple orifices 20 therein. Device 12 may include one light source 30, two light guides 38 that are each positioned along the width 24 of printzone 26 adjacent to sides 14*a* and 14*b* of array 14, respectively, and a detection device 36 including two light diodes, each one positioned at an end 14*d* of array 14 and each connected to a light guide 38, and including two light diodes, each one positioned at an end 14*c* of array 14 and connected to a light guide 38. In this embodiment, detection device 12 may further include mirrors 42 positioned at end 14*c* of array 14 to direct light beam 32 to pass over all of die 18 within array 14. In this embodiment, detection devices 36 positioned at the right upper and lower left side of the figure may be the primary light detectors because these detectors may detect a stronger light signal than the detection devices 36 on the left upper and right lower side of the figure. Accordingly, in another embodiment, detection devices 36 on the upper left and lower right side of the figure may be optional and may not be utilized.

Figure 7:
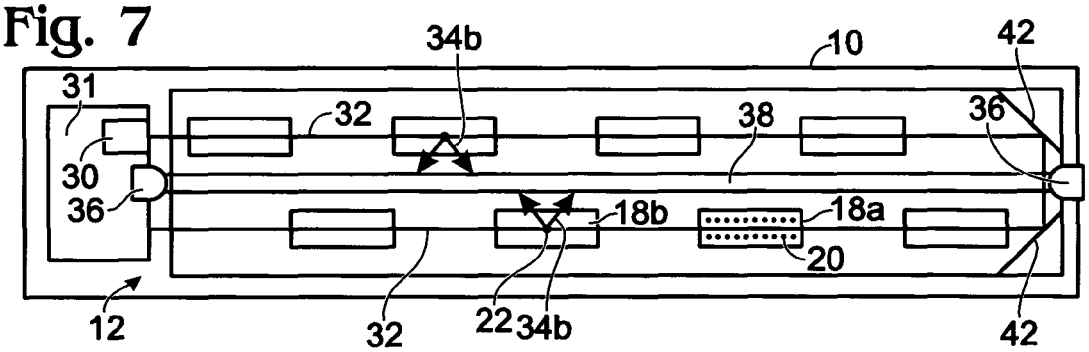

FIG. 7 is a schematic bottom view of one example embodiment of a printing device 10 including one example embodiment of a printing orifice health detection device 12. Device 10 may include an array 14 including multiple die 18, each die 18 including multiple orifices 20 therein. Device 12 may include one light source 30, one light guide 38 that is positioned along the width 24 of printzone 26 down a center of array 14, and a detection device 36 including a light diode positioned at an end 14*d* of array 14 and connected to light guide 38. In this embodiment, detection device 12 may further include mirrors 42 positioned at end 14*c* of array 14 to direct light beam 32 to pass over all of die 18 within array 14. In this embodiment, detection devices 36 positioned at the right side of the figure may be the primary light detectors because these detectors may detect a stronger light signal than the detection devices 36 on the left side of the figure. Accordingly, in another embodiment, detection devices 36 on the left side of the figure may be optional and may not be utilized.

Figure 8:
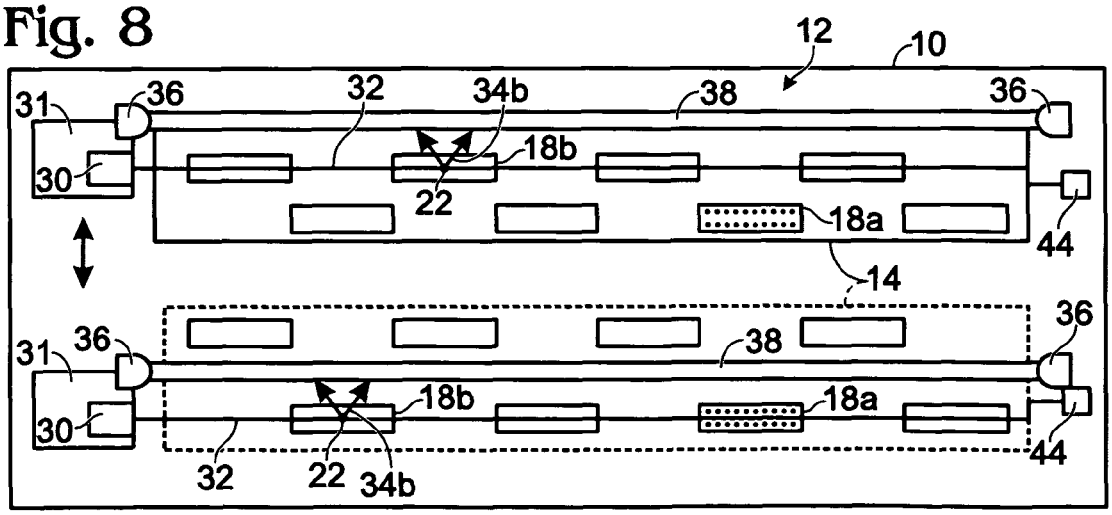

FIG. 8 is a schematic bottom view of one example embodiment of a printing device 10 including one example embodiment of a printing orifice health detection device 12 wherein array 14 has been indexed between a first position (top of figure) and a second position, shown in dash lines (bottom of figure). Device 10 may include an array 14 including multiple die 18, each die 18 including multiple orifices 20 therein. Device 12 may include one light source 30, one light guide 38 that is positioned along the width 24 of printzone 26 and across array 14, and one detection device 36 including a light diode positioned at an end 14*d* of array 14 and connected to light guide 38. In this embodiment, detection device 12 may further include a motor 44, such as a stepper motor, configured to move array 14 between a first position (top of figure) and a second position, shown in dash lines (bottom of figure) so that light beam 32 will be projected over the top four die 18 of array 14 in the first position, and will be projected over the bottom four die 18 of array 14 in the second position. In this embodiment, one light detector is utilized to detect light from all eight die 18 of this particular embodiment of array 14. Accordingly, this embodiment may be less expensive to manufacture than an embodiment utilizing two light sources, two light guides 38 and two or more light detectors 36. In this embodiment, detection devices 36 positioned at the right side of the figure may be the primary light detectors because these detectors may detect a stronger light signal than the detection devices 36 on the left side of the figure. Accordingly, in another embodiment, detection devices 36 on the left side of the figure may be optional and may not be utilized.

Figure 9:
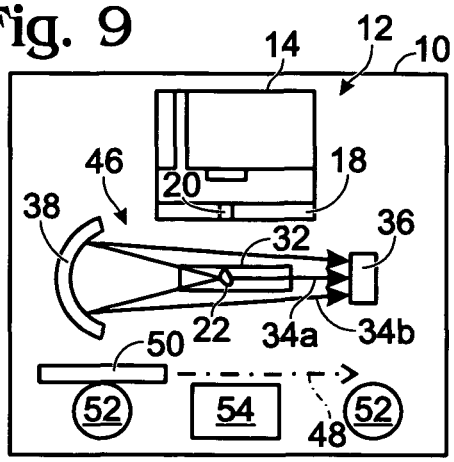
FIGS. 9-10 are schematic side views of example embodiments of a printing device including example embodiments of components of a printing orifice health detection device.
Figure 10:
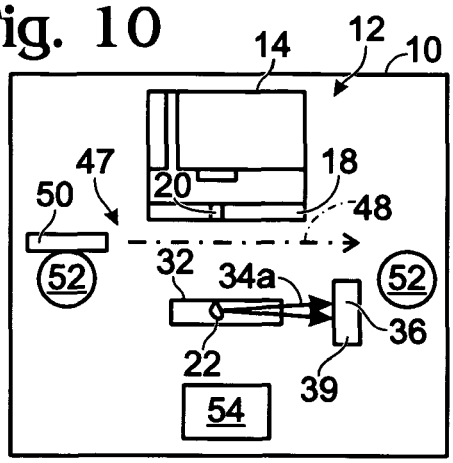

FIGS. 9-10 are schematic side views of example embodiments of a printing device 10 including example embodiments of a printing orifice health detection device 12.

FIG. 9 shows an embodiment including a light source 30 (see FIGS. 1-8) that projects light beam 32 through a position 46 between array 14 and a print media path 48 or a service station. Accordingly, in this embodiment, a health of orifices 20 may be determined during printing of ink 22 on a print media 50 or during dispensing ink for nozzle health detection into a service station in a platen between printed pages, without interruption of the printing process. This side view of printing device 10 shows a print media support structure 52, and a service station 54 positioned below orifices 20.

FIG. 10 shows an embodiment including a light source 30 (see FIGS. 1-8) that projects light beam 32 through a position 47 opposite a print media path 48 from array 14, i.e., below print media path 48. Accordingly, in this embodiment, a health of orifices 20 may be determined during ejection of ink 22 into service station 54 between printing on individual sheets of print media 50. This embodiment may be utilized in printers 10 wherein, for example, small space constraints may hinder placement of projected light beam 32 between die 18 and print media path 48. In this embodiment, light detector 36 and light guide 39 may comprise the same structural element, and no reflector 38 may be utilized.

Figure 11:
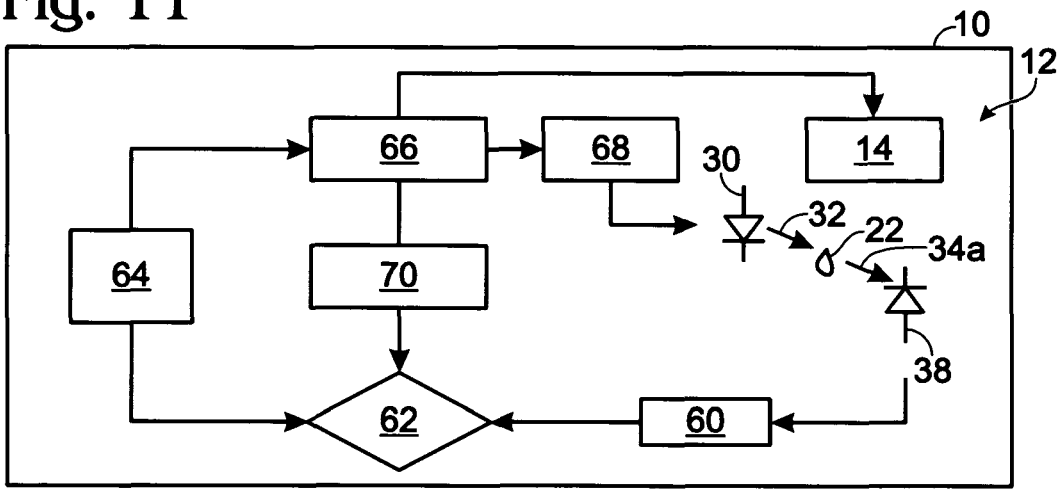
FIG. 11 is a block diagram showing example components of the print device including an example print orifice health detection device.

FIG. 11 is a block diagram showing example components of the print device 10 including an example print orifice health detection device 12. An ink ejection array 14, including orifice plate 16, ejects one or more droplets 22 through light beam 32, wherein light beam 32 is generated by light source 30. The scattered light 32*a* and/or 32*b* is detected by light detector 38 and the signal is converted to an electrical signal and transmitted to an amplifier 60. The signal from amplifier 60 is transmitted to a comparator 62 which transmits the light scattering information to a central processing unit (CPU) 64, such as a computer. Computer 64 then uses this information to control an ink jet controller 66 which in turn controls a light source driver 68 and printhead 18. The ink jet controller 66 may conduct a delay calculation 70 that is transmitted to comparator 62 wherein this information is utilized by computer 64 to determine the health of individual orifices of printhead 15.

FIGS. 12-15 are schematic side views of example embodiments of a printing device 10 including example embodiments of a printing orifice health detection device 12.

Figure 12:
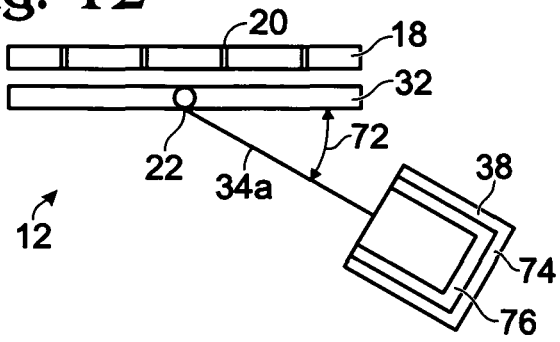
FIGS. 12-17 are schematic side views of example embodiments of a printing device including example embodiments of components of a printing orifice health detection device.

FIG. 12 shows a square light guide device 38 positioned below orifice plate 18 and light beam 32 at an angle 72 of approximately thirty degrees. Light guide device 38 may include a housing 74 that includes reflective material 76 positioned on an interior surface of housing 74.

Figure 13:
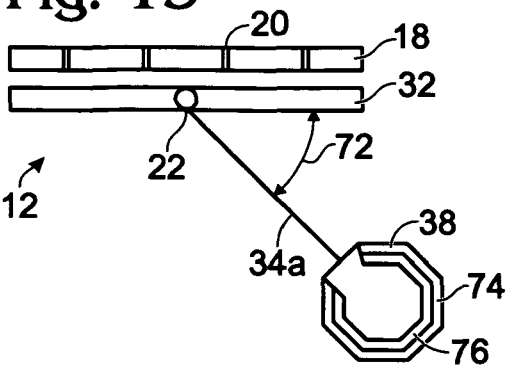

FIG. 13 shows an octagonal light guide device 38 positioned below orifice plate 18 and light beam 32 at an angle 72 of approximately forty five degrees. Light guide device 38 may include a housing 74 that includes reflective material 76 positioned on an interior surface of housing 74.

Figure 14:
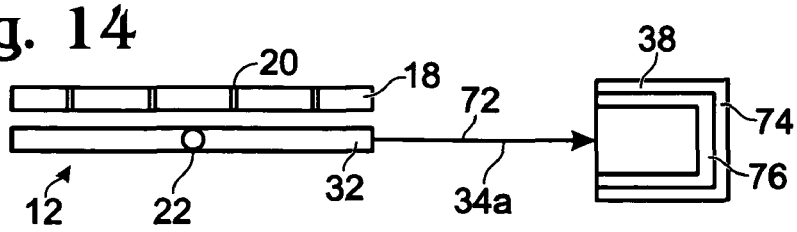

FIG. 14 shows a rectangular light guide device 38 positioned below orifice plate 18 and aligned in the same horizontal plane as light beam 32, i.e., at an angle 72 of zero degrees. Light guide device 38 may include a housing 74 that includes reflective material 76 positioned on an interior surface of housing 74.

Figure 15:
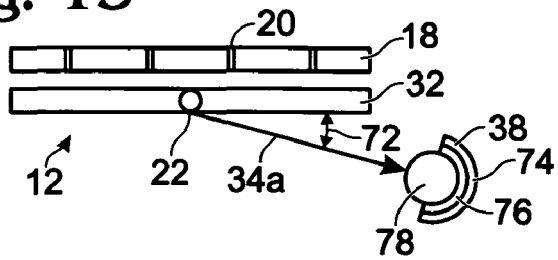

FIG. 15 shows a semi-circular light guide device 38 positioned below orifice plate 18 and light beam 32 at an angle 72 of approximately fifteen degrees. Light guide device 38 may include a housing 74 that includes reflective material 76 positioned on an interior surface of housing 74 and a transparent material 78, such as glass.

Figure 16:
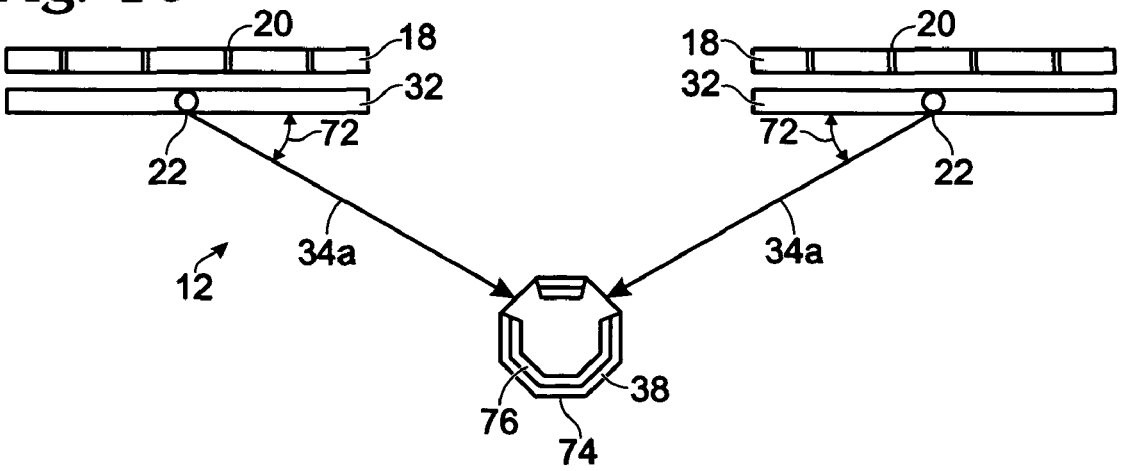

FIG. 16 shows an octagonal light guide device 38 positioned below two orifice plates 18 and two light beams 32 at angle 72 of approximately thirty degrees. Light guide device 38 may include a housing 74 that includes reflective material 76 positioned on an interior surface of housing 74 and may allow scattered light 32*a* to enter octagonal light guide device 38 at two locations.

Figure 17:
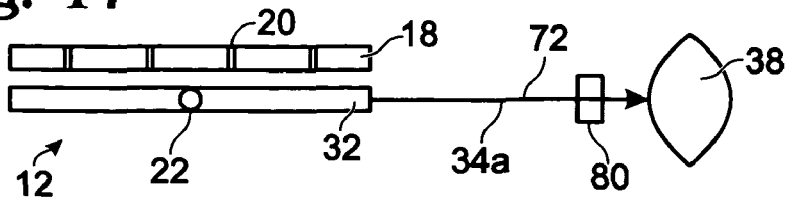

FIG. 17 shows a light guide device 38 formed as a lens. The light guide device 38 is positioned below orifice plate 18 and aligned in the same horizontal plane as light beam 32, i.e., at an angle 72 of approximately zero degrees. A stopper 80 may be positioned adjacent light guide device 38 so as to allow scattered light 34*a* to be transmitted to light guide device 38 but so as to deter transmission of the main light beam through light guide device 80.

In other embodiments, other shapes, locations, angles, and the like of the components, or other components, of the system may be utilized for the determination of orifice health.

Other variations and modifications of the concepts described herein may be utilized and fall within the scope of the claims below.

We claim:

1. An orifice health detection device, comprising:

a page wide array of ink ejecting orifices, each of said ink ejecting orifices configured to eject at least one ink drop;

a light source that produces a light beam configured to scatter light from said at least one ejected ink drop;

a light detector configured to detect light scattered from said at least one ejected ink drop; and a light guide positioned adjacent to a path of said light beam and configured to direct said scattered light to said light detector, wherein the light guide is configured with a length such that scattered light is collected into the light guide at multiple locations along its length.

2. The device of claim 1 wherein said page wide array is chosen from the group consisting of a fixed array and an indexing array that is indexed for movement only along a direction parallel to a print media path.

3. The device of claim 1 wherein a printzone is positioned between a print media path and said page wide array, and wherein said light beam extends through a position chosen from the group consisting of a position between said print media path and said page wide array and a position opposite said print media path from said page wide array.

4. The device of claim 1 wherein said light guide is chosen from the group consisting of a light guide that extends along and is parallel to a length of said page wide array, and a light guide that is positioned perpendicular to a length of said page wide array.

5. The device of claim 1 wherein said light guide has a cross sectional shape chosen from the group consisting of a square, a rectangle, a semi-circle, and an octagon.

6. The device of claim 1 wherein said light source includes at least one laser light source.

7. The device of claim 1 wherein said light detector is chosen from the group consisting of a contact image sensor and a photodiode.

8. The device of claim 1 wherein said page wide array comprises a plurality of die extending across a width of said printzone.

9. The device of claim 1 wherein said light guide is chosen from the group consisting of a reflective device and a lens.

10. The device of claim 1 further comprising a controller that receives light scattering information detected by said light detector, said controller utilizing said light scattering information to determine a health of an orifice that ejected said at least one ejected ink drop.

11. A method of detecting print orifice health, comprising:

projecting a light beam adjacent to a page wide array of ink ejecting orifices in a printing device;

ejecting at least one ink drop from said page wide array and through said light beam;

collecting light scattered from said light beam when said ink drop passes through into a light guide positioned adjacent to a path of said light beam; and detecting light scattered from said at least one ejected ink drop and collected by said light guide;

wherein the light guide is configured with a length such that scattered light is collected into the light guide at multiple locations along its length.

12. The method of claim 11 further comprising utilizing said detected scattered light to determine a health of an orifice that ejected said at least one ejected ink drop.

13. The method of claim 12 wherein said step of ejecting comprises simultaneously ejecting ink drops from multiple orifices of said page wide array, wherein said step of detecting comprises detecting light scattered from said ink drops from multiple orifices, and further comprising utilizing said detected scattered light to determine a health of each orifice that ejected individual ones of said ejected ink drops.

14. The method of claim 11 further comprising collecting said scattered light in a light collector, and wherein said step of detecting detects said scattered light from said light collector.

15. The method of claim 11 wherein said projecting a light beam comprises projecting said light beam along a position chosen from the group consisting of a position between a print media path and said page wide array and a position opposite a print media path from said page wide array.

16. A method of manufacturing a drop detection device, comprising:

providing a page wide array of ink ejecting orifices, said ink ejecting orifices configured to eject at least one ink drop;

positioning a light source to produce a light beam configured to scatter light from said at least one ejected ink drop; positioning a light detector to detect light scattered from said at least one ejected ink drop;

positioning a light guide adjacent to a path of said light beam and positioned to direct said scattered light to said light detector, wherein the light guide is configured with a length such that scattered light is collected into the light guide at multiple locations along its length.

17. The method of claim 16 further comprising positioning a light guide so as to direct said scattered light to said light detector.

18. The method of claim 16 further comprising connecting a controller to said light detector, said controller configured to determine a health of an orifice that ejected said at least one ejected ink drop based on said detected scattered light.

* * * * *